United States Patent [19]

Rust et al.

[11] 4,171,033

[45] Oct. 16, 1979

[54] SCAFFOLD DEVICE

[76] Inventors: Willard J. Rust; Willard M. Rust, both of Spencer, Boyd County, Nebr. 68777

[21] Appl. No.: 938,066

[22] Filed: Aug. 30, 1978

Related U.S. Application Data

[63] Continuation-in-part of Ser. No. 639,921, Dec. 11, 1975, Pat. No. 4,125,173.

[51] Int. Cl.[2] ..... E04G 1/20; E04G 1/24

[52] U.S. Cl. ..... 182/63; 182/127; 182/145

[58] Field of Search ..... 182/145, 63, 127, 146, 182/142, 223, 222; 280/142

[56] References Cited

U.S. PATENT DOCUMENTS

| | | | |
|---|---|---|---|
| 1,442,694 | 1/1923 | Martin | 182/172 |
| 2,106,923 | 2/1938 | Tuft | 280/142 |
| 3,576,233 | 4/1971 | Thatcher | 182/145 |
| 3,851,728 | 12/1974 | Williams | 182/146 |
| 4,125,173 | 11/1978 | Rust | 182/63 |

*Primary Examiner*—Reinaldo P. Machado
*Attorney, Agent, or Firm*—Zarley, McKee, Thomte, Voorhees & Sease

[57] ABSTRACT

A scaffold device comprising a wheeled frame means including a front axle assembly and a rear axle assembly which are pivotally interconnected about a horizontal axis whereby either of the axle assemblies may be pivoted or rotated relative to the other. A first post is pivotally connected at its lower end to the front axle assembly and extends downwardly therefrom. A telescoping support is pivotally connected at its lower end to the front axle assembly and extends upwardly to a pivotal connection with the first post to permit the first post to be vertically positioned regardless of the attitude of the front axle assembly. A second post is pivotally secured at its lower end to the rear axle assembly and extends upwardly therefrom. A telescoping support is pivotally connected at its lower end to the rear axle assembly and is pivotally connected at its upper end to the second post adjacent the upper end thereof to permit the second post to be vertically positioned regardless of the attitude of the rear axle assembly. A platform is slidably mounted on the first and second posts and extends therebetween. The ends of the platform are raised and lowered by means of a winch mounted on each of the first and second posts. A safety catch apparatus is provided for preventing the inadvertent downward vertical movement of the platform relative to the posts. A brake apparatus is provided on each of the rear wheels for preventing the scaffold device from moving.

10 Claims, 12 Drawing Figures

SCAFFOLD DEVICE

BACKGROUND OF THE INVENTION

This is a continuation-in-part application of application Ser. No. 639,921 filed Dec. 11, 1975, U.S. Pat. No. 4,125,173.

This invention relates to a scaffold device and more particularly to a scaffold device mounted on a wheeled frame means.

Conventional scaffolding ordinarily comprises a plurality of vertical posts which are interconnected by cross-braces and which may be stacked on top of each other to permit workmen to work walls or the like. The erection of the conventional scaffolds is time consuming and is difficult when the terrain adjacent the wall or the like is irregular. The limited width of the scaffolds requires that additional scaffolding be placed adjacent thereto or that the scaffolding be moved laterally as each portion of the wall is completed.

A vastly improved scaffold device is described in the copending application. The instant invention represents an improvement over the previous device in that failure of the previous winches could result in the platform falling thereby causing injury to the workmen. In the previous invention, the wheels of the frame means had to be blocked to prevent the inadvertent rolling of the frame means.

Therefore, it is a principal object of the invention to provide an improved scaffold device.

A further object of the invention is to provide a scaffold device which is mounted on a running gear.

A further object of the invention is to provide a scaffold device which is mounted on a wheeled frame means including means for adjusting the attitude of the scaffold.

A further object of the invention is to provide a scaffold device which is easily moved from location to location.

A further object of the invention is to provide a scaffold device which is easily assembled and diassembled.

A further object of the invention is to provide a scaffold device having the ability to be adjusted for irregular terrain.

A further object of the invention is to provide a scaffold device including means for preventing the inadvertent downward movement of the platform with respect to its support posts.

A still further object of the invention is to provide a scaffold device having a brake means associated therewith.

A still further object of the invention is to provide a scaffold device including a worm gear apparatus for vertically positioning the support posts.

A still further object of the invention is to provide a scaffold device which is economical of manufacture, durable in use and refined in appearance.

DESCRIPTION OF THE PREFERRED EMBODIMENT

Figures 1, 2, 3, 4, 5, 6:
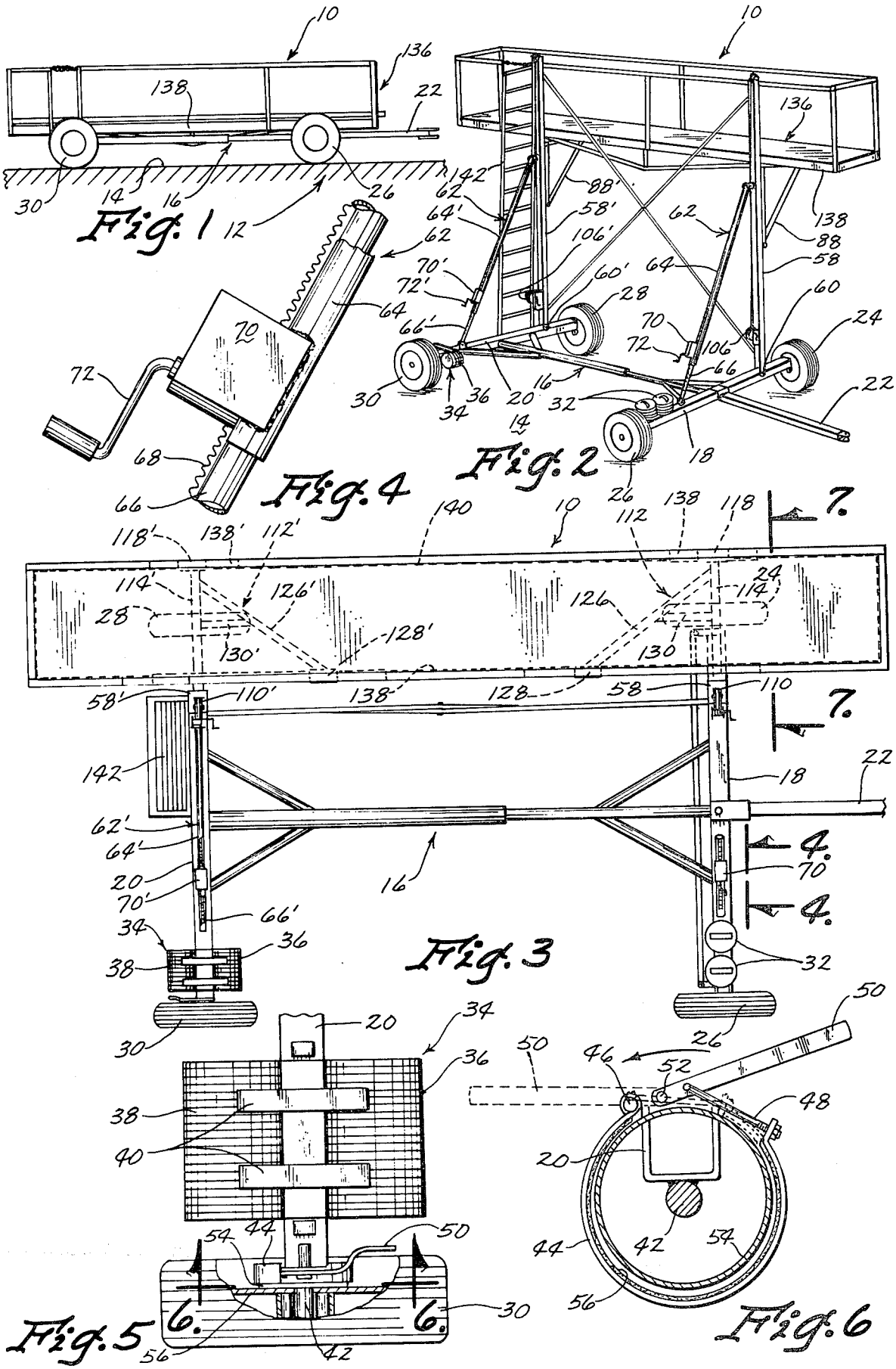
FIG. 1 is a side view of the scaffold device in a transport position.
FIG. 2 is a front perspective view of the scaffold device in an erected condition.
FIG. 3 is a top view of the scaffold device.
FIG. 4 is an enlarged sectional view seen on lines 4—4 of FIG. 3.
FIG. 5 is a partial top view of the counterweight and brake apparatus with portions thereof cut away to more fully illustrate the invention.
FIG. 6 is an enlarged sectional view seen on lines 6—6 of FIG. 5.
Figures 7, 8, 9, 10, 11, 12:
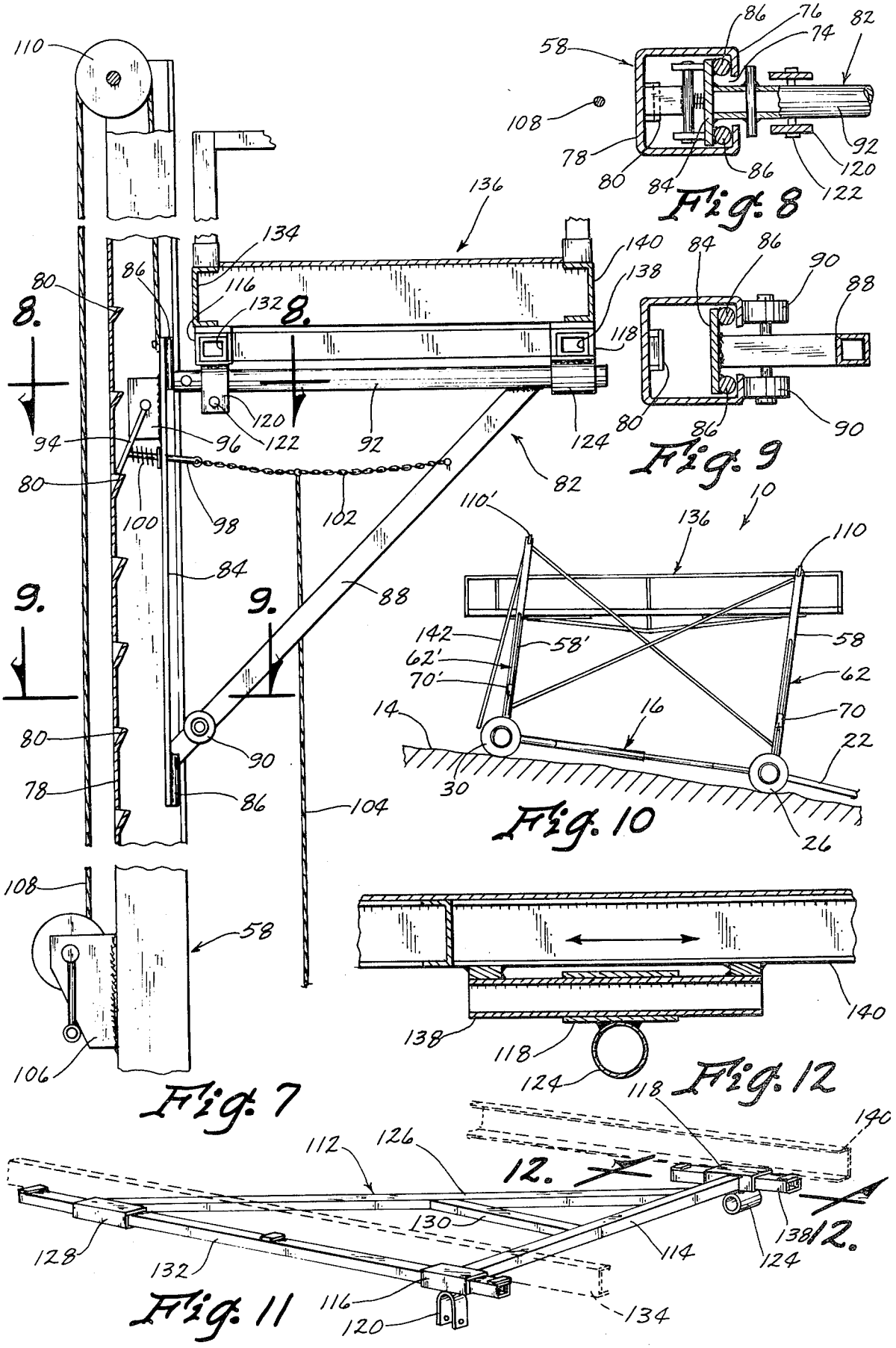
FIG. 7 is an enlarged partial sectional view seen on lines 7—7 of FIG. 3.
FIG. 8 is an enlarged sectional view seen on lines 8—8 of FIG. 7.
FIG. 9 is an enlarged sectional view seen on lines 9—9 of FIG. 7.
FIG. 10 is a side view illustrating the scaffold device being used on irregular terrain.
FIG. 11 is a partial perspective view of the means for supporting one end of the platform.
FIG. 12 is an enlarged sectional view seen on lines 12—12 of FIG. 11.

The scaffold of this invention is referred to generally by the reference numeral 10 while the reference numeral 12 will be used to refer to the level ground in FIG. 1 and the reference numeral 14 will be used to indicate the uneven terrain in FIG. 10. Scaffold 10 includes a wheeled frame means or running gear 16 of generally conventional design and similar to farm wagon running gears. Frame means 16 includes a front axle assembly 18 and a rear axle assembly 20 which are pivotally or rotatably connected about a horizontal axis in conventional fashion so that either of the axle assemblies may be rotated relative to the other. Hitch 22 extends forwardly from front axle assembly 18 for pulling the frame means from location to location. Front axle assembly 18 includes a pair of wheels 24 and 26 while rear axle assembly shown) extend upwardly from front axle assembly 18 for supporting a pair of wheel weights 32 thereon. The numeral 34 refers to a wheel weight means which is positioned on the rear axle assembly 20 as illustrated in FIGS. 2 and 5. Wheel weight means 34 includes a pair of spaced-apart weights 36 and 38 connected together by a support means 40 so that the support means 40 may rest upon rear axle assembly 20 in the manner illustrated in the drawings.

As seen in the drawings, rear axle assembly 20 includes a spindle portion 42 which extends outwardly from the end of the axle assembly. A circular band 44 is pivotally connected at one end thereof to axle assembly 20 at 46 and has an adjustment bolt 48 connected to the other end thereof. Adjustment bolt 48 is pivotally connected to lever 50 which is pivotally connected to the axle assembly 20 at 52. Wheel 30 is provided with annular ring 54 which extends inwardly from the wheel portion 56 and which is embraced by the band 44. When the lever 50 is in the position illustrated by solid lines in FIG. 6, there is no frictional engagement between band 44 and ring 54. However, when the lever 50 is pivotally moved to the position illustrated by broken lines in FIG. 6, band 44 frictionally engages ring 54 to prevent rotation of wheel 30 to prevent inadvertent movement of the scaffold when being used. It is preferred that the inside surface of band 44 have a brake lining material such as that illustrated by the reference numeral 56 in FIG. 6. While the drawings illustrate a brake only on wheel 30, it should be understood that brakes could be employed on all of the wheels if desired. The brake means illustrated in FIGS. 5 and 6 eliminates the need for blocking or otherwise preventing the scaffold from rolling during use.

Support post 58 is pivotally connected at its lower end to front axle assembly 18 at 60 and extends upwardly therefrom. Length-adjustable support 62 is pivotally connected at its upper end to post 58 and is pivotally connected at its lower end to the front axle assembly 18 as illustrated. Support 62 is comprised of telescoping members 64 and 66. As seen in the drawings, member 64 is provided with exposed gear teeth 68 which extend outwardly from an elongated slot formed in member 64. Worm gear support 70 is secured to member 64 and has a pinion gear or the like mounted therein which is in engagement with the teeth 68 and which is rotated by the handle 72. Thus, rotation of handle 72 causes the pinion gear (not shown) to be rotated so that member 66 is telescopically moved with respect to member 64 to enable the post 58 to be vertically positioned as desired. Inasmuch as the scaffold support structure at the rearward end of the apparatus is identical to that just described, "prime mark" will be used to indicate identical structure on the drawings.

Post 58 is of tubular construction and has an elongated vertical slot or opening 74 provided in its outer wall 76 as illustrated in FIG. 8. The inner wall 78 of post 58 is provided with a plurality of stops 80 which extend inwardly to the interior of post 58 as illustrated. The stops 80 are formed by simply punching wall 78 inwardly at the spaced-apart locations to provide the stops 80.

The numeral 82 refers to a triangular shaped scaffold support which is vertically mounted on post 58. Support 82 includes a vertically disposed bar 84 which is positioned within post 58 as illustrated in the drawings. Bar 84 is provided with guides 86 at the upper and lower ends thereof which engage the inside surface of wall 76 on opposite sides of openings 74 as also seen in the drawings. Brace 88 is secured to bar 84 adjacent the lower end thereof and extends upwardly and outwardly therefrom through the opening 74. Rollers 90 are rotatably mounted on the brace 88 and engage the exterior surface of wall 76 on opposite sides of the opening 74 as seen in FIG. 9. Pipe 92 is secured at one end thereof to the upper end of bar 84 and extends outwardly through the opening 94. The upper end of brace 82 is secured to pipe 92 adjacent the outer end thereof as seen in FIG. 7. The numeral 94 refers to a safety catch arm pivotally secured at its upper end to support 96 which is welded to bar 84 adjacent the upper end thereof. Pin 98 is secured to arm 94 and extends outwardly through bar 84 as seen in FIG. 7. Spring 100 embraces pin 98 between arm 94 and bar 84 for yieldably urging arm 94 towards the left as viewed in FIG. 7 or towards the stops 80. Chain 102 is secured to the outer end of pin 98 and brace 88. Release cable 104 is secured to chain 102 and extends downwardly therefrom. Winch 106 is secured to post 58 adjacent the lower end thereof and has a cable 108 extending upwardly therefrom over pulley 110 and downwardly to the upper end of bar 84. When it is desired to raise the scaffold support 82 with respect to the post 58, winch 106 is operated to vertically move scaffold support 82. As the lower end of arm 94 engages one of the stops 100 during the upward movement of the support 82, the arm simply pivotally moves thereover. As soon as the lower end of the arm 94 clears the upper end of the stop 80, spring 100 urges the arm 94 towards the left or above the stop 80. When the scaffold support 82 is in the desired position, the scaffold support 82 is lowered slightly by the winch 106 until the lower end of the arm 94 positively engages one of the stops 80 thereby taking the tension out of the cable 100. Thus it can be seen that the safety catch arm 94 will prevent downward movement of the scaffold support 82 should failure occur in the cable 108.

When it is desired to lower the scaffold support 82, winch 106 is operated to first slightly move the scaffold support 82 upwardly to disengage arm 94 from the stop 80. Cable 104 is then pulled which causes pin 98 to pull arm 94 to the right as viewed in FIG. 7 or out of engagement with stop 80. Winch 106 may then be operated to lower the scaffold support 82 to the desired position. An identical winch, safety catch and scaffold support structure is provided on post 58 prime and thus will not be described in detail.

The numeral 112 refers to a scaffold support which is removably secured to pipe 92 of scaffold support 82. Scaffold support 112 is best illustrated in FIG. 11 and includes a horizontally disposed tubular member 114 having transversely extending tubular members 116 and 118 secured to the opposite ends thereof. A U-shaped clamp 120 extends downwardly from tubular member 116 and is designed to embrace one end of pipe 92 as seen in FIG. 7. A pin 122 is extended through the clamp 120 to maintain clamp 120 on pipe 92. Pipe portion 124 is secured to the lower surface of tubular member 118 and is designed to embrace the outer end of pipe 92 as also illustrated in FIG. 7. Brace 126 extends diagonally from tubular member 114 and has a tubular member 128 mounted at the end thereof. Brace 130 interconnects 126 and tubular member 114. Tubular member 132 is slidably received in the tubular members 116 and 128 and is welded to the underside of frame member 134 of the platform referred to generally by the reference numeral 136. Likewise, tubular member 138 is slidably received in tubular member 116 and is welded to the underside of frame member 140 of platform 138. The structure just described permits the attachment of one end of the platform 136 to the pipe 92. It should be understood that the other end of the platform is also secured to comparable structure on post 58'. The means for attaching the platform 136 to the pipe 92 permits the platform to be pivotally moved with respect to the pipe 92 which is essential if the posts 58 and 58' are not perfectly vertically disposed such as would be the case in FIG. 10. The structure for mounting the platform 136 on the pipe 92 also permits a certain amount of horizontal movement between the platform and the pipe 92 so that the mounting structure may move relative to the pipe 92 if both of the posts 58 are not perfectly vertically disposed. The numeral 142 refers generally to a ladder which is provided adjacent the post 58'.

The scaffold device of this invention may be easily disassembled and placed on the welded frame means 16 when the scaffold is to be transported for long distances. When the desired location has been reached, the scaffold device is assembled as previously described. The wheeled frame means 16 is driven or pulled adjacent the wall or the like and the pivotal connection between the front and rear axle assemblies does not require that the wheels be perfectly level. In fact, either of the axle assemblies could be pivoted as much as 30° relative to the other without causing any serious problems. The means for attaching the platform to the support posts 58 and 58' as described also permits the scaffold to be used in the manner illustrated in FIG. 10 when the front wheels are lower or higher than the rear wheels. As seen in FIG. 10, it is possible to position the platform 136 in a horizontal position even though the front and rear wheels of the apparatus are not level.

When the wheeled frame means 16 is in position, post 58 is easily vertically positioned through the use of the worm gear apparatus and the telescopic tubes 64 and 66. The means for connecting the telescopic tubes of this invention is an improvement over applicant's earlier invention in that the worm gear apparatus provides a positive connection between the two which prevents inadvertent movement between the two members.

The winches 106 and 106' are operated to cause the platform 136 to be raised and lowered relative to the posts 58 and 58' as previously described to enable the workmen to work on the wall structure or the like at any desired height. Since the platform 136 extends outwardly from the posts 58 and 58', the area beneath the platform is free and clear of obstructions so that the workmen may work on the wall structure below the platform. The fact that each end of the platform is individually adjustably controlled by the winch on the respective post permits the platform to be precisely adjusted regardless of whether the supporting axle assembly is higher or lower than the other axle assembly as also previously described. The device is easily moved along the length of the wall structure by simply pulling the same relative thereto.

Thus it can be seen that a novel scaffold device has been provided which is not only safe to use but which is convenient and which does not require the time consuming erection of individual scaffolds as in conventional scaffolding devices. It can therefore be seen that the scaffold device accomplishes at least all of its stated objectives.

We claim:

1. A scaffold device, comprising, a wheelded frame means comprising a front axle assembly and a rear axle assembly, said front and rear axle assemblies being pivotally connected together about a horizontal axis whereby one of said axle assemblies may be pivoted relative to the other, a first support having upper and lower ends, said first support being selectively pivotally secured at its lower end to said front axle assembly and extending upwardly thereform, a second support having upper and lower ends, said second support being selectively pivotally secured at its lower end to said rear axle assembly and extending upwardly therefrom, a platform vertically movably mounted on said first and second supports and extending therebetween, and means for raising and lowering said platform relative to said first and second supports, each of first and second supports comprising a tubular means having first and second pairs of oppositely disposed walls, one of said walls in said first pair of walls having a vertical slot formed therein which vertically movably receives a portion of said platform, the other wall of said first pair of walls having a plurality of vertically spaced stops provided thereon on the inside surface thereof, said platform having a pair of selectively movable means provided thereon which normally engage one of the stops in each of said tubular means for preventing inadvertent downward movement of said platform relative to said supports.

2. The device of claim 1 wherein said means for raising and lowering said platform comprises a winch means mounted on each of said supports.

3. The device of claim 2 wherein each of said winch means is operatively connected to one end of said platform.

4. The device of claim 1 wherein each of said movable means comprises a spring loaded arm pivotally connected to said platform.

5. The device of claim 4 wherein said spring loaded arm has upper and lower ends and is pivotally connected at is upper end to said platform.

6. The device of claim 4 wherein an elongated flexible member is secured to each of said spring loaded arms for moving said arms out of engagement with said stops.

7. A scaffold device, comprising, a wheeled frame means comprising a front axle assembly and a rear axle assembly, said front and rear axle assemblies being pivotally connected together about a horizontal axis whereby one of said axle assemblies may be pivoted relative to the other, a first support having upper and lower ends, said first support being selectively pivotally secured at its lower end to said front axle assembly and extending upwardly therefrom, a second support having upper and lower ends, said second support being selectively pivotally secured at its lower end to said rear axle assembly and extending upwardly therefrom, a platform vertically movable mounted on said first and second supports and extending therebetween, and means for raising and lowering said platform relative to said first and second supports, at least one of the wheels of said wheeled frame means having a brake assembly thereon.

8. The device of claim 7 wherein said brake assembly comprises an annular ring secured to the wheel and a selectively closable band secured to the axle assembly and embracing said ring.

9. A scaffold device, comprising, a wheeled frame means comprising a front axle assembly and a rear axle assembly, said front and rear axle assemblies being pivotally connected together about a horizontal axis whereby one of said axle assemblies may be pivoted relative to the other, a first support having upper and lower ends, said first support being selectively pivotally secured at its lower end to said front axle assembly and extending upwardly therefrom, a second support having upper and lower ends, said second support being selectively pivotally secured at its lower end to said rear axle assembly and extending upwardly therefrom, first and second platform supports vertically movably mounted on said first and second supports, a platform pivotally secured, about a horizontal axis, to said platform supports and extending therebetween.

10. The device of claim 9 wherein said platform is operatively slidably mounted on said supports.

* * * * *